US008393207B2

(12) United States Patent
Fujisawa et al.

(10) Patent No.: US 8,393,207 B2
(45) Date of Patent: Mar. 12, 2013

(54) METHODS AND APPARATUS TO USE MULTIPLE SENSORS TO MEASURE DOWNHOLE FLUID PROPERTIES

(75) Inventors: Go Fujisawa, Sagamihara (JP); Sophie Nazik Godefroy, East Ahmadi (KW)

(73) Assignee: Schlumberger Technology Corporation, Sugar Land, TX (US)

( * ) Notice: Subject to any disclaimer, the term of this patent is extended or adjusted under 35 U.S.C. 154(b) by 921 days.

(21) Appl. No.: 12/371,628

(22) Filed: Feb. 16, 2009

(65) Prior Publication Data

US 2010/0206063 A1 Aug. 19, 2010

(51) Int. Cl.
*E21B 49/10* (2006.01)
*G01V 9/00* (2006.01)

(52) U.S. Cl. ..... 73/152.24; 702/11

(58) Field of Classification Search ..... 702/6, 11–13; 73/152.23–152.28

See application file for complete search history.

(56) References Cited

U.S. PATENT DOCUMENTS 5,146,414 A * 9/1992 McKown et al. ..... 702/49
5,345,077 A * 9/1994 Allen et al. ..... 250/264
5,602,732 A * 2/1997 Nichols et al. ..... 701/29
5,838,634 A * 11/1998 Jones et al. ..... 367/73
7,542,853 B2 * 6/2009 Lapierre et al. ..... 702/6
2006/0041795 A1 * 2/2006 Gabelmann et al. ..... 714/699
2008/0189561 A1 * 8/2008 Singh ..... 713/300
2008/0307876 A1 * 12/2008 Lapierre et al. ..... 73/152.51
2009/0157320 A1 * 6/2009 Abubakar et al. ..... 702/11
2009/0222399 A1 * 9/2009 Gomez et al. ..... 706/52
2010/0274139 A1 * 10/2010 Fukukita et al. ..... 600/459

* cited by examiner

*Primary Examiner* — John Fitzgerald
(74) *Attorney, Agent, or Firm* — Jianguang Du; Jody DeStefanis; Jeff Griffin

(57) ABSTRACT

Methods and apparatus to use multiple sensors to measure downhole fluid properties are described. An example method of measuring a property of a downhole fluid involves obtaining a plurality of measurements for each of a plurality of sensors. Each of the measurements corresponds to a same property of the downhole fluid, and each of the sensors is differently configured to measure the property. Additionally, the example method involves obtaining a plurality of weighting values, each of which corresponds to one of the sensors. The example method also involves applying the weighting values to the respective measurements obtained by each of the corresponding sensors to generate a weight-corrected measurement for each of the sensors. Further still, the example method involves generating a value representative of a measurement of the property of the downhole fluid based on the weight-corrected measurements and outputting the value representative of the measurement of the property.

12 Claims, 7 Drawing Sheets

METHODS AND APPARATUS TO USE MULTIPLE SENSORS TO MEASURE DOWNHOLE FLUID PROPERTIES

FIELD OF THE DISCLOSURE

This patent relates generally to sampling and analyzing formation fluids and, more particularly, to methods and apparatus to use multiple sensors to measure downhole fluid properties.

BACKGROUND

Downhole fluid analysis is often used to provide information in real time about the composition of subterranean formations or reservoir fluids. Such real-time information can be used to improve or optimize the effectiveness of formation testing tools during sampling processes in a well. For example, downhole fluid composition analysis allows for reducing and/or optimizing the number of samples captured and brought back to the surface for further analysis. More generally, collecting accurate data about the characteristics of formation fluid(s) is an important aspect of making reliable predictions about a formation or reservoir and, thus, can have a significant impact on reservoir performance such as production quality, volume, efficiency, etc.

While there are numerous sensors that may be utilized in a downhole environment to measure a property or properties of downhole fluids, each of these sensors typically has limitations, which affect their operation under certain downhole conditions. As a result of these limitations, the quality of the measurements obtained via these sensors may be compromised under certain downhole conditions.

SUMMARY

Methods and apparatus to use multiple sensors to measure downhole fluid properties are described. An example method of measuring a property of a downhole fluid involves obtaining a plurality of measurements for each of a plurality of sensors. Each of the measurements corresponds to a same property of the downhole fluid, and each of the sensors is differently configured to measure the property. Additionally, the example method involves obtaining a plurality of weighting values, each of which corresponds to one of the sensors. The example method also involves applying the weighting values to the respective measurements obtained by each of the corresponding sensors to generate a weight-corrected measurement for each of the sensors. Further still, the example method involves generating a value representative of a measurement of the property of the downhole fluid based on the weight-corrected measurements and outputting the value representative of the measurement of the property.

An example apparatus to measure a downhole fluid property includes a plurality of differently configured sensors to measure a same property of the downhole fluid. Additionally, the example apparatus includes a processing unit to generate a value representative of the property of the downhole fluid based on the measurements obtained by the sensors and a plurality of weighting values, each of which corresponds to one of the sensors.

The patent or application file contains at least one drawing executed in color. Copies of this patent or patent application publication with color drawings will be provided by the Office upon request and payment of the necessary fee.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The example methods and apparatus described herein can use a plurality of measurements obtained via different sensors (e.g., sensors employing different sensing principles) to generate a value representative of a measurement of a property of a downhole fluid. The use of multiple differently configured sensors may provide a more reliable and/or accurate result(s) than may be obtained if the property is determined based on a measurement(s) provided by a single sensor.

In particular, the examples described herein determine weighting values that correspond to each of the sensors and which depend on the operational status and/or condition of each corresponding sensor under particular downhole conditions. For example, if a sensor is inoperable or performs poorly under a particular downhole condition (e.g., an elevated viscosity), the weighting value that corresponds to that sensor will be relatively lower than another sensor (e.g., zero) that is fully operable under the same downhole condition. The weighting values may then be applied to the measurements obtained via the corresponding sensors to generate weight-corrected measurement for each sensor. Each of the weight-corrected measurements may then be utilized to generate a weighted average value of the measurements obtained by the sensors. Such an approach enables the examples described herein to obtain more accurate and/or reliable measurements of downhole fluids under a broader range of downhole conditions.

Figure 1:
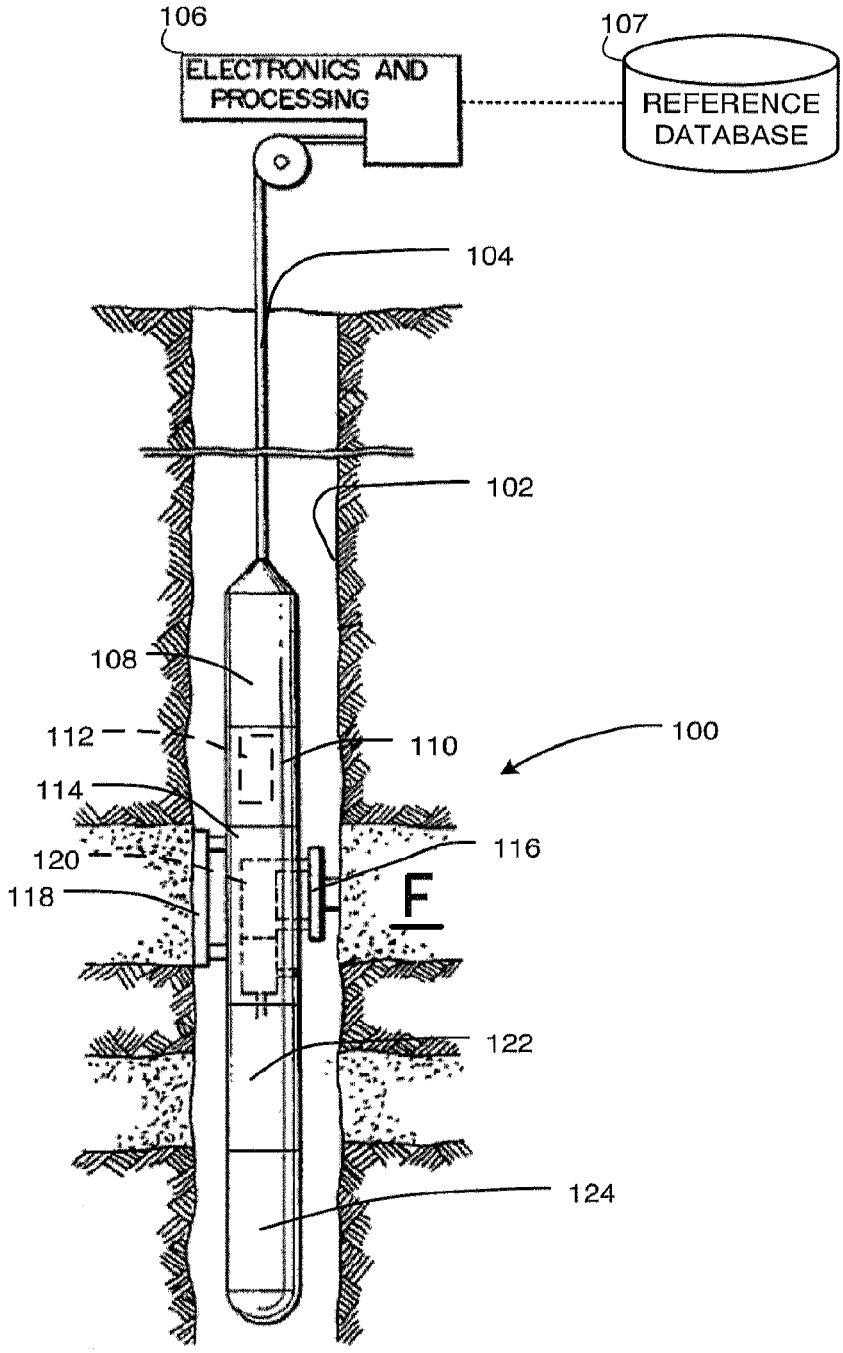
FIG. 1 depicts an example wireline tool that may be used to implement the methods and apparatus described herein.

FIG. 1 depicts an example wireline tool 100 that may be used to extract and analyze formation fluid samples. Specifically, the example wireline tool 100 may be used to generate a value representative of a measurement of a property of a downhole fluid using the example methods and apparatus described herein. In some examples, the property of the downhole fluid may be viscosity, density and/or fluid composition. However, the examples described herein can be used to determine any other parameter or characteristic of a formation fluid sample and/or a downhole condition.

As shown in FIG. 1, the example wireline tool 100 is suspended in a borehole or wellbore 102 from the lower end of a multiconductor cable 104 that is spooled on a winch (not shown) at the surface. At the surface, the cable 104 is communicatively coupled to an electronics and processing system 106. The electronics and processing system 106 may include or be communicatively coupled to a reference database 107 that may be used to store reference measurement values of reference formation fluids known to have particular viscosities, densities, and/or fluid compositions under particular downhole conditions. The wireline tool 100 includes an elongated body 108 that includes a collar 110 having a downhole control system 112 configured to control extraction of formation fluid from a formation F, perform measurements on the extracted fluid, and to control the apparatus described herein to generate a value representative of a measurement of a property of a downhole fluid.

The example wireline tool 100 also includes a formation tester 114 having a selectively extendable fluid admitting assembly 116 and a selectively extendable tool anchoring member 118 that are respectively arranged on opposite sides of the elongated body 108. The fluid admitting assembly 116 is configured to selectively seal off or isolate selected portions of the wall of the wellbore 102 to fluidly couple to the adjacent formation F and draw fluid samples from the formation F. The formation tester 114 also includes a fluid analysis module 120 through which the obtained fluid samples flow. The sample fluid may thereafter be expelled through a port (not shown) or it may be sent to one or more fluid collecting chambers 122 and 124, which may receive and retain the formation fluid samples for subsequent testing at the surface or a testing facility.

In the illustrated example, the electronics and processing system 106 and/or the downhole control system 112 are configured to control the fluid admitting assembly 116 to draw fluid samples from the formation F and to control the fluid analysis module 120 to measure the fluid samples. In some example implementations, the fluid analysis module 120 may be configured to analyze the measurement data of the fluid samples as described herein. In other example implementations, the fluid analysis module 120 may be configured to generate and store the measurement data and subsequently communicate the measurement data to the surface for analysis at the surface. Although the downhole control system 112 is shown as being implemented separate from the formation tester 114, in some example implementations, the downhole control system 112 may be implemented in the formation tester 114.

As described in greater detail below, the example wireline tool 100 may be used in conjunction with the example methods and apparatus described herein to generate a value representative of a measurement of a property of a downhole fluid. For example, the formation tester 114 may include one or more sensors, fluid analyzers and/or fluid measurement units disposed adjacent a flowline and may be controlled by one or both of the downhole control system 112 and the electronics and processing system 106 to determine the composition of and/or a characteristic of fluid samples extracted from, for example, the formation F.

While the example methods and apparatus to generate a value representative of a measurement of a property of a downhole fluid are described in connection with a wireline tool such as that shown in FIG. 1, the example methods and apparatus can be implemented with any other type of wellbore conveyance. For example, the example methods and apparatus can be implemented with a drill string including logging-while-drilling (LWD) and/or measurement-while-drilling (MWD) modules, coiled tubing, etc.

Figure 2:
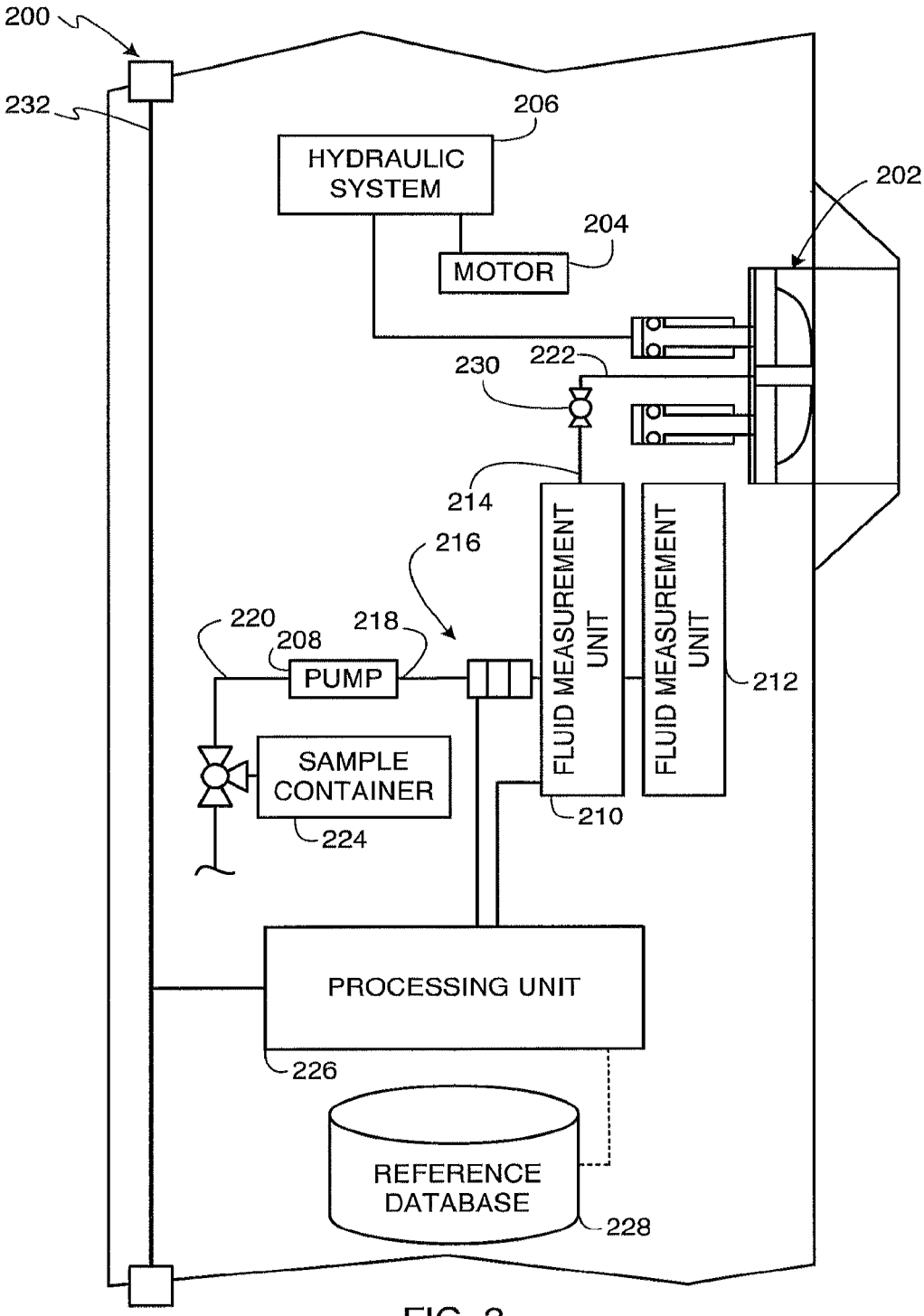
FIG. 2 is a simplified schematic illustration of an example manner in which the formation tester of FIG. 1 may be implemented.

FIG. 2 is a simplified schematic illustration of an example formation sampling tool 200 that may be used to implement the formation tester 114 of FIG. 1. The example formation sampling tool 200 includes a probe assembly 202 that can be selectively fluidly coupled to a surface of a wellbore via a motor 204 and a hydraulic system 206 to draw fluids from a formation (e.g., the formation F). In other example implementations, straddle packers (not shown) can additionally or alternatively be used to engage and isolate a portion of the surface of a wellbore to draw fluids from the formation. The formation sampling tool 200 is also provided with a pump 208 that may be used to draw fluids from the formation into the formation sampling tool 200.

The formation sampling tool 200 includes one or more fluid sensors to measure characteristics of the fluids drawn into the formation sampling tool 200. As used herein, a "sensor" may refer to a fluid measurement unit as well to any other type of sensor or sensing device. In the illustrated example, the formation sampling tool 200 is provided with a first fluid measurement sensor or unit 210 and a second fluid measurement sensor or unit 212 to measure one or more characteristics of formation fluids. The formation fluids may comprise at least one of a heavy oil, a bitumen, a volatile oil, a gas condensate, a wet gas, a dry gas, a drilling fluid, a wellbore fluid or, more generally, any fluid extracted from a subsurface formation. Each of the fluid measurement units 210 and/or 212 may be implemented using, for example, a light absorption spectrometer having a plurality of channels, each of which may correspond to a different wavelength. Thus, the fluid measurement units 210 and/or 212 may be used to measure spectral information for fluids drawn from a formation. In other implementations, each of the fluid measurement units 210 and/or 212 may be implemented using a VIS/NIR spectrometer, a VIS spectrometer, an NIR spectrometer, a resistivity measurement unit and/or any other suitable type of spectrometer.

The fluid measurement units 210 and 212 may be differently configured and/or employ different sensing principles to measure the same property of the downhole fluid such as, for example, fluid composition. For example, the first fluid measurement unit 210 may be a VIS spectrometer and the second fluid measurement unit 212 may be a NIR spectrometer. Thus, as described in more detail below, the examples described herein can utilize a plurality of fluid composition measurements obtained via, for example, the differently configured fluid measurement units 210 and 212, to generate a value representative of the fluid composition of the downhole fluid over a broader range of downhole conditions than if the fluid composition is determined based on a measurement(s) made via a single sensor or sensing device. While the formation sampling tool 200 is depicted as having two fluid measurement units, the formation sampling tool 200 may be provided with any number (e.g., 1, 2, 3, 4, etc.) of fluid measurement units, which may be the same (i.e., similarly or identically configured) and/or different. Some commercially available fluid measurement units 210 and/or 212 include the Composition Fluid Analyzer (CFA) and InSitu Fluid Analyzer (IFA) provided by Schlumberger®.

Generally, each of the above described implementations of the fluid measurement units 210 and 212 may be used to measure spectral information for fluids drawn from a formation and/or to measure any other characteristic(s) of the fluids. Such spectral information may include characteristic values such as optical density values associated with each of the channels and may be used to, for example, determine the composition of the fluid(s). Additionally or alternatively, the fluid measurement units 210 and/or 212 may be configured to measure a flowrate of the downhole fluid relative to a flowline 214 and/or a density, a fluid resistivity, a viscosity, salinity, a gas-oil ratio (GOR) and/or any other fluid property or characteristic of the downhole fluid.

The formation sampling tool 200 is also provided with one or more additional sensors 216 to measure a flowrate of the downhole fluid relative to a flowline 218 and/or a pressure, a temperature, a density, a fluid resistivity, a viscosity, salinity, a gas-oil ratio and/or any other fluid properties or characteristic(s). While the sensors 216 are depicted as being in-line with the flowline 218, one or more of the sensors 216 may be used in other flowlines 214, 220, and 222 within the example formation sampling tool 200.

Some of the additional sensors 216 may be differently configured and/or employ different sensing principles to measure the viscosity of the downhole fluid. For example, one of the sensors 216 may be a vibrating plate or paddle sensor to measure density/viscosity of the downhole fluid (herein after referred to as DV-rod sensor) (e.g., InSitu Density sensor provided by Schlumberger® ) and another one of the sensors 216 may be a vibrating rod sensor, both of which may be used to measure viscosity of the downhole fluid. Thus, as described in more detail below, the examples described herein can utilize a plurality of viscosity measurements obtained via, for example, different ones of the sensors 216 to generate a value representative of the viscosity of the downhole fluid over a broader range of downhole conditions than if the viscosity was determined based on measurement(s) made using only one sensor.

In other examples, some of the sensors 216 may be differently configured and/or employ different sensing principles to measure the density of the downhole fluid. For example, one of the sensors 216 may be a InSitu Density densitometer provided by Schlumberger® and another one of the sensors 216 may measure density using x-ray attenuation and/or gamma-ray attenuation. Additionally or alternatively, one of the sensors 216 may be a Modular formation Dynamics Tester (MDT) provided by Schlumberger® used to derive a density value from a pressure gradient. Thus, as described in more detail below, the examples described herein can utilize a plurality of density measurements obtained via, for example, different ones of the sensors 216 to generate a value representative of the density of the downhole fluid over a broader range of downhole conditions than if the density was determined based on a measurement(s) made using only one sensor.

The formation sampling tool 200 may also include a fluid sample container or store 224 including one or more fluid sample chambers in which formation fluid(s) recovered during sampling operations can be stored and brought to the surface for further analyses and/or confirmation of downhole analyses. In other example implementations, the fluid measurement units 210 and 212 and/or the sensors 216 may be positioned in any other suitable position such as, for example, between the pump 208 and the fluid sample container or store 224.

To store, analyze and/or process test and measurement data (or any other data acquired by the formation sampling tool 200), the formation sampling tool 200 is provided with a processing unit 226 that may be communicatively coupled to a reference database 228, which may be used to store measurement values of reference formation fluids known to have particular fluid compositions, viscosities, and/or densities. Specifically, the processing unit 226 may utilize values stored in, for example, the reference database 228 to determine a theoretical value of a property of the downhole fluid based on a comparison of measured values (e.g., flow rate, fluid composition, temperature, pressure) and known values (e.g., drilling fluid properties) with the reference values.

Generally, each of the additional sensors 216 and/or the fluid measurement units 210 and 212 have different strengths and weaknesses and may be operable and/or provide different performance characteristics under different downhole conditions. As a result, the accuracy of measurements provided by the sensors 216 and/or the fluid measurement units 210 and 212 may vary depending on the operational status of the sensors 210, 212 and 216 and/or the conditions downhole (e.g., temperature, pressure, etc.). For example, a status of each of the sensors 216 and/or the fluid measurement units 210 and 212 may be associated with or determined based on an amount of deviation of the measurements provided by the sensors 216 and/or the fluid measurement units 210 and 212 from a theoretical value of a property of the downhole fluid. The amount of deviation from the theoretical value of the property may be related to an amount of noise associated with the sensors 216 and/or the fluid measurement units 210 and/or 212. Similarly, the measurements obtained by some of the sensors 216 and/or the fluid measurement units 210 and 212 may only be reliable, for example, under particular flow conditions, particular rates of fluid change and/or up to a certain maximum viscosity.

To compensate for unreliable and/or inaccurate measurements obtained by any of the sensors 216 and/or the fluid measurement units 210 and 212, the processing unit 226 determines weighting values for each of the sensors 216 and/or the fluid measurement units 210 and 212 based on their operational status and the conditions downhole. In some examples, the weighting values may be between about zero and one, where zero corresponds to a highly unreliable and/or inaccurate measurement and one corresponds to a highly reliable and/or accurate measurement. For example, if one of the sensors 216 obtains relatively accurate measurements when the viscosity of the downhole fluid is relatively high, that sensor may be assigned a corresponding weighting value of approximately one for measurements it makes under such a condition. Alternatively, if one of the sensors 216 obtains relatively inaccurate measurements When the viscosity of the downhole fluid is relatively low, that sensor may be assigned a corresponding weighting value of approximately zero for measurements it makes under such a condition. Once the corresponding weighting values are determined for each of the sensors 216 and/or the fluid measurement units 210 and 212, the processing unit 226 may apply the weighting values to the measurements obtained via the fluid measurement units 210 and/or 212 and/or the respective sensors 216 to generate weight-corrected measurements. In some examples, applying the weighting values to the measurement(s) includes multiplying each of the respective weighting values by its corresponding measurement. The processing unit 226 may then generate a value representative of a measurement of a property of the downhole fluid based on the weight-corrected measurements. Specifically, the processing unit 226 may sum the weight-corrected measurements to generate a weighted average value representative of the property. For example, if each of the measurements is a density value, then the weighted average value of the weight-corrected measurements is a value representative of the density of the downhole fluid.

Figure 7:
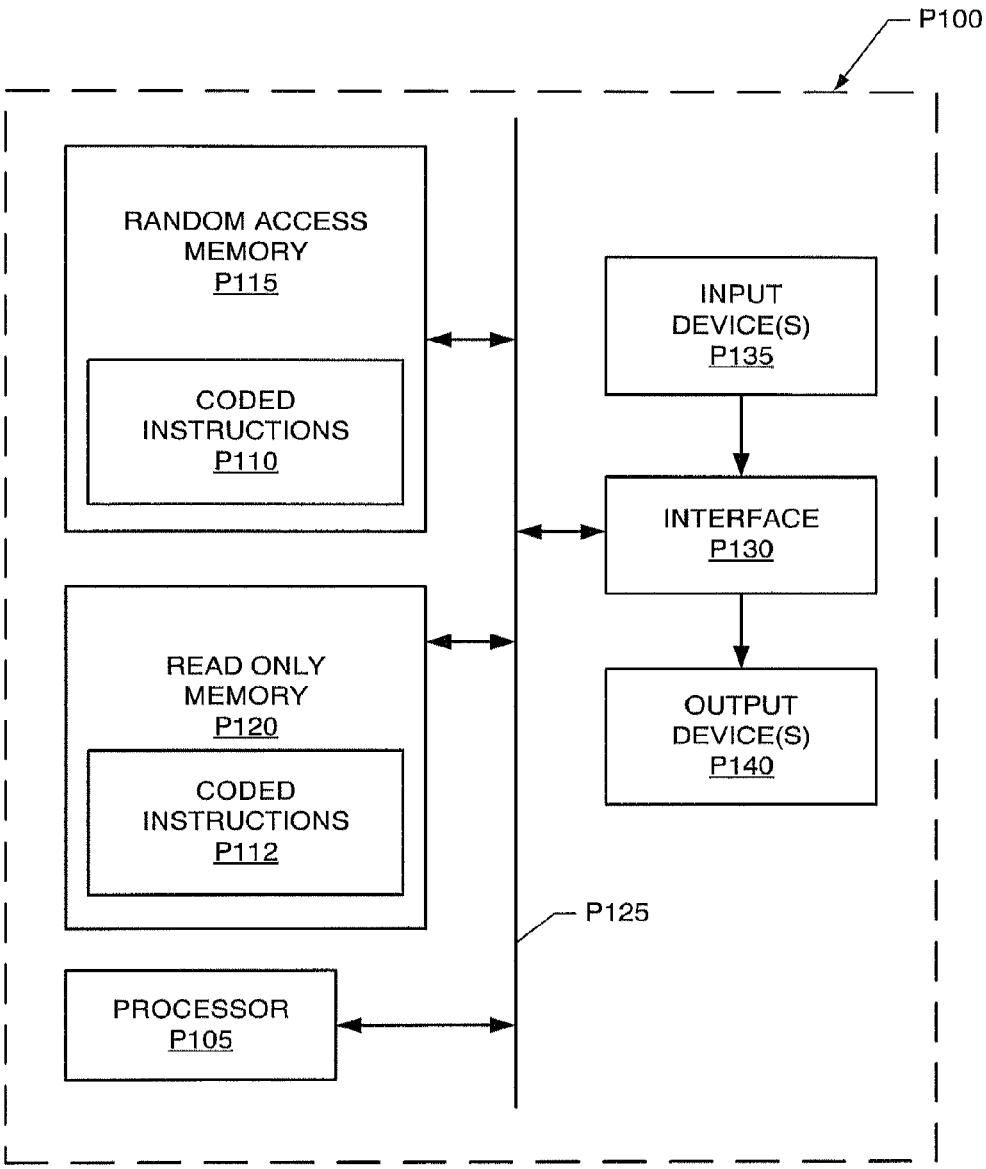
FIG. 7 is a schematic illustration of an example processor platform that may be used and/or programmed to implement any or all of the example methods and apparatus described herein.

The processing unit 226 may be generally implemented as shown in FIG. 7. In the illustrated example, the processing unit 226 may include a processor (e.g., a CPU and random access memory such as shown in FIG. 7) to control operations of the formation sampling tool 200 and implement measurement routines. For example, the processing unit 226 may be used to control the fluid measurement units 210 and 212 to perform spectral measurements of fluid characteristics of formation fluid, to actuate a valve 230 to enable a fluid sample to flow into the flowline 214, and to determine a theoretical value of a property of the downhole fluid based on a condition of the downhole fluid determined by one or more of the sensors 216 and/or the fluid measurement units 210 and/or 212 as well as known values (e.g., drilling fluid properties). Additionally, the processing unit 226 can iteratively generate a value representative of a measurement of a property of a downhole until a difference between the generated values (e.g., a difference between a value generated in association with one iteration and a value generated in association with a subsequent iteration) is at or below a predetermined parameter or threshold or until a predetermined number of iterations have taken place (e.g., ten iterations). The processing unit 226 may further include any combination of digital and/or analog circuitry needed to interface with the sensors 216 and/or the fluid measurement units 210 and 212.

To store machine readable instructions (e.g., code, software, etc.) that, when executed by the processing unit 226, cause the processing unit 226 to implement measurement processes or any other processes described herein, the processing unit 226 may be provided with an electronic programmable read only memory (EPROM) or any other type of memory (not shown). To communicate information when the formation sampling tool 200 is downhole, the processing unit 226 is communicatively coupled to a tool bus 232, which may be communicatively coupled to a surface system (e.g., the electronics and processing system 106).

Although the components of FIG. 2 are shown and described above as being communicatively coupled and arranged in a particular configuration, the components of the formation sampling tool 200 can be communicatively coupled and/or arranged differently than depicted in FIG. 2 without departing from the scope of the present disclosure. In addition, the example methods and apparatus described herein are not limited to a particular conveyance type but, instead, may be implemented in connection with different conveyance types including, for example, coiled tubing, wireline, wired-drill-pipe, and/or other conveyance means known in the industry.

Figure 3:
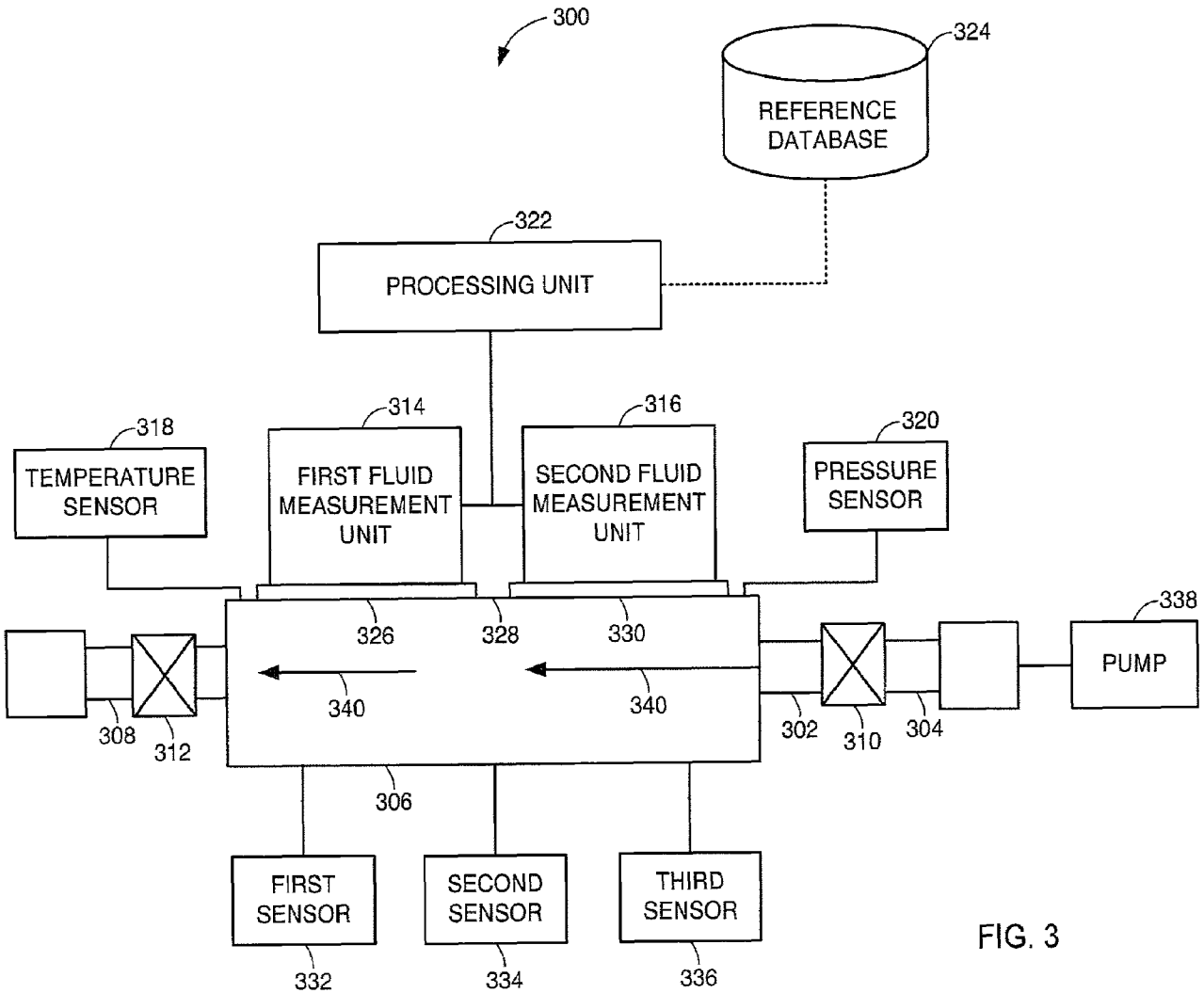
FIG. 3 is a schematic illustration of an example apparatus that may be used to implement a portion of the formation sampling tool of FIG. 2.

FIG. 3 illustrates an example apparatus 300 that may be used to implement a portion of the formation sampling tool 200 associated with the pump 208, the fluid measurement units 210 and 212, the flowline 214, the sensors 216, the processing unit 226 and/or the reference database 228 of FIG. 2. The example apparatus 300 includes a flowline 302 that includes a first flowline section 304, a second flowline section 306 and a third flowline section 308. A first valve 310 is positioned between the first and second flowline sections 304 and 306 and a second valve 312 is positioned between the second and third flowline sections 306 and 308. The first and second valves 310 and 312 are to control fluid flow through the flowline 302. Specifically, the first valve 310 may open to enable fluid to flow into the second flowline section 306 and the second valve 312 may close to prevent fluid from flowing out of the second flowline section 306. To retain a sample in the second flowline section 306, the first and second valves 310 and 312 may be closed. However, measurements may be obtained from the fluid while both the first and second valves 310 and 312 are open. The valves 310 and 312 may be any suitable valve that may be operable in subterranean formation conditions.

To measure a characteristic of the sample in the second flowline section 306 once a sample has been retained in the second flowline section 306, the example apparatus 300 is provided with a first fluid measurement unit 314 and a second fluid measurement unit 316. Specifically, the fluid measurement units 314 and/or 316 determine the composition of the fluid sample. Additionally, the fluid measurement units 314 and/or 316 may measure a flowrate of the sample relative to the second flowline section 306, a density, a fluid resistivity, a viscosity, salinity, a gas-oil ratio and/or any other fluid conditions, properties or characteristics of the sample. If the fluid measurement units 314 and/or 316 identify that the sample includes water, the fluid measurement units 314 and/or 316 may determine the salinity of the sample. Alternatively, if the fluid measurement units 314 and/or 316 identify that the sample includes oil and gas, the fluid measurement units 314 and/or 316 may determine the gas-oil ratio of the sample.

The first fluid measurement unit 314 is provided with a first window 326 (e.g., an optical window) that is substantially adjacent a surface 328 of the second flowline section 306. Similarly, the second fluid measurement unit 316 is provided with a second window 330 (e.g., an optical window) that is substantially adjacent the surface 328 of the second flowline section 306. The windows 326 and 330 may be implemented using any suitable material such as a scratch resistant material (e.g., a sapphire material). The windows 326 and/or 330 may be substantially flush with the surface 328, or the windows 326 and/or 330 may be partially positioned within (e.g., extend into) the second flowline section 306.

The measured values obtained using the fluid measurement units 314 and/or 316 along with known properties of the drilling fluid and the temperature and pressure measurements obtain via a temperature sensor 318 and a pressure sensor 320 may be advantageously utilized to determine a value of a theoretical property or characteristic (e.g., a theoretical viscosity value, a theoretical density value or a theoretical fluid composition value) of the sample in the second flowline section 306 based on a comparison by a processing unit 322 of the measured values and known values with reference values stored in, for example, a reference database 324. The reference values may be reference values that were obtained from the subterranean formation being sampled or similar subterranean formations. Alternatively, the reference values may be generated from laboratory experiments under controlled conditions.

To measure a fluid property (e.g., a viscosity or density value) of the sample, the example apparatus 300 is provided with a first sensor 332, a second sensor 334 and a third sensor 336. The sensors 332, 334 and/or 336 may be differently configured and/or employ different sensing principles to measure the same property of the sample such as, for example, viscosity or density. In some examples, at least one of the sensors 332, 334 and/or 336 may have a first shape and a first mode of vibration and another one of the sensors 332, 334 and/or 336 may have a second shape and a second mode of vibration.

If the sensors 332, 334 and 336 are configured to measure the viscosity of the sample, the first sensor 332 may be a DV-rod sensor, the second sensor 334 may be a vibrating wire sensor configured for frequency domain operation and the third sensor 336 may be a vibrating wire sensor configured for time domain operation. A DV-rod sensor typically includes an elongated member (e.g., similar to an oar), which is driven in different vibration modes. One of the vibration modes may be approximately perpendicular to the longitudinal axis of the elongated member and another one of the vibration modes may be parallel to the longitudinal axis of the elongated member. The two vibration modes may create ring down signals (e.g., impulses) in the sample, which substantially eliminate any effect on the sensor from pressure and/or temperature. A vibrating wire sensor operating in a frequency domain configuration may scan a spectrum in approximately twenty seconds, and the resulting spectrum or spectral information may be used to calculate a viscosity of the sample based on a measured resonance frequency and Q-factor. However, a vibrating wire sensor may measure a ring down signal in time domain and calculate a viscosity of the sample based on a measured frequency and a damping factor.

All of the above-identified sensors have different operational characteristics. For example, a DV-rod sensor may measure the viscosity of a fluid sample in approximately one second and is not sensitive to fluid changes, but is sensitive to flow conditions and has a relatively limited or low maximum measureable viscosity. However, a vibrating wire sensor operating in a frequency domain configuration may be capable of measuring samples having a relatively high viscosity and can withstand relativity high velocity flows. Additionally, measurements obtained via a vibrating wire sensor operating in a frequency domain configuration have relatively high resolution and accuracy. However, to obtain an accurate measurement using the vibrating wire sensor operating in a frequency domain configuration, the sample may have to remain substantially the same or unchanged for approximately 20 seconds and, thus, a vibrating wire sensor operating in such a frequency domain configuration is sensitive to fluid composition changes. For example, if the sample changes from water to oil in less than twenty seconds, the measurements obtained via the vibrating wire sensor operating in a frequency domain configuration may not be sufficiently accurate. A vibrating wire sensor operating in a time domain configuration has a similar measurement mode to the DV-rod sensor, but has similar hardware to the vibrating wire sensor operating in a frequency domain configuration. The vibrating wire sensor operating in a time domain configuration may measure the viscosity of the sample in approximately one second because it is relatively insensitive to fluid change and can withstand relativity high velocity flows. However, the vibrating wire sensor operating in a time domain configuration has a relatively low maximum measureable viscosity.

In operation, to determine or estimate the viscosity of the formation fluid sample using the example apparatus 300, a pump 338, which may be used to implement the pump 208 of FIG. 2, pumps fluid (e.g., formation fluid) through the flowline 302 in a direction generally indicated by arrows 340. As the fluid moves through the flowline 302, the first and second valves 310 and 312 may actuate to a closed position to retain a sample within the second flowline section 306. In some examples, the second valve 312 may be actuated to the closed position before the first valve 310 is actuated to the closed position so that a predetermined amount of fluid has entered the second flowline section 306.

The fluid measurement units 314 and/or 316 then measure a fluid composition of the sample. Additionally, the fluid measurement units 314 and/or 316 may measure a flowrate of the sample relative to the second flowline section 306, a density, a fluid resistivity, salinity and/or a gas-oil ratio of the sample. The temperature sensor 318 and the pressure sensor 320 are then used to measure the pressure (e.g., 3700 psi) and the temperature (e.g., 64° C.) of the sample, respectively. These measured and known conditions, characteristics and/or parameters of the sample (e.g., the flowrate, the fluid composition, the density, the pressure, drilling fluid properties and the temperature) are then compared to conditions, characteristics and/or parameters stored in the reference database 324 to determine a theoretical viscosity value (e.g., 2 centipoise (cP) or 20 cP) of the sample.

Each of the first, second and third sensors 332, 334 and 336 then measures the viscosity of the sample, and the processing unit 322 compares each of the measurements to the determined theoretical viscosity value. Based on an amount of deviation from the determined theoretical viscosity, the processing unit 322 determines a status of each of the sensors 332, 334 and 336. For example, if one of the measurements obtained via one of the sensors 332, 334 or 336 deviates substantially from the determined theoretical viscosity, the processing unit 322 may associate a status of "improperly functioning" with the respective one of the sensors 332, 334 and/or 336, which negatively impacts a weighting value that corresponds to that sensor 332, 334, and/or 336. Alternatively, for example, if one of the measurements obtained via one of the sensors 332, 334 or 336 does not deviate significantly from the determined theoretical viscosity, the processing unit 322 may associate a status of "properly functioning" with the respective one of the sensors 332, 334 and/or 336, which positively impacts a weighting value that corresponds to that sensor 332, 334, and/or 336.

The processing unit 322 then determines weighting values for each of the sensors 332, 334 and 336 based on the status of each of the sensors 332, 334 and 336 and the condition of the downhole fluid. For example, if the measurements obtained via all of the sensors 332, 334 and 336 are substantially similar, the processing unit 322 may assign weighting values to each of the sensors 332, 334 and 336 that are substantially the same and, thus, measurements obtained via each of the sensors 332, 334 and 336 are weighted substantially equally. However, if the measurements obtained via the first sensor 332 deviate substantially from the theoretical viscosity and/or measurements obtained via the other sensors 334 and 336, the processing unit 322 may assign a weighting value of approximately zero to the first sensor 332 because this deviation may indicate that the first sensor 332 failed to properly measure the viscosity of the sample (e.g., is failed or improperly functioning sensor). As a result, in this example, measurements obtained via the first sensor 332 are given relatively little, if any, weight and/or will not be taken into consideration (e.g., may be eliminated) when generating a value representative of the viscosity of the sample. Additionally, if the measurements obtained via the second sensor 334 do not deviate significantly from the theoretical viscosity and/or measurements obtained via the other sensors 332 and 336, the processing unit 322 may assign a weighting value of approximately one to the second sensor 334 and, thus, measurements obtained via the second sensor 334 are given a relatively large amount of weight when generating a value representative of the viscosity of the sample. If the third sensor 336 is a DV-rod sensor and the flow conditions are relatively stable and the viscosity of the downhole fluid is relatively low, the processing unit 322 may assign a weighting value of approximately one to the third sensor 336 and, thus, measurements obtained via the third sensor 336 are given a relatively large amount of weight when generating a value representative of the viscosity of the sample. Alternatively, if the third sensor 336 is a DV-rod sensor or a vibrating wire sensor operating in a time domain configuration and the viscosity of the downhole fluid is relatively high, the processing unit 322 may assign a weighting value of approximately zero to the third sensor 336 and, thus, measurements obtained via the third sensor 336 are given relatively little, if any, weight when generating a value representative of the viscosity of the sample. In other examples, if the third sensor 336 is a DV-rod sensor and the velocity of the downhole fluid is above a predetermined level, the processing unit 322 may assign a smaller weighting value (e.g., approximately zero) to the third sensor 336 and, thus, measurements obtained via the third sensor 336 are given relatively little, if any, weight when generating a value representative of the viscosity of the sample.

The processing unit 322 then applies the determined weighting values to the respective measurements obtained by each of the corresponding sensors 332, 334 and 336 to generate weight-corrected measurements for each of the sensors 332, 334 and 336. In some examples, applying the weighting values to the respective measurements includes multiplying each of the measurements by its corresponding weighting value. However, the weighting values may be applied to the respective measurements in any other suitable way.

Once the weight-corrected measurements are determined for each of the sensors 332, 334 and 336, the processing unit 322 then generates and outputs a value representative of the viscosity of the sample based on the weight-corrected measurements. Generating the value representative of the viscosity of the sample may include summing the weight corrected measurements and/or averaging the weight corrected measurements. Generally, the processing unit 322 can iteratively generate a value representative of the viscosity of the sample based on the status of the sensors 332, 334 and 336 and a condition(s) of the downhole fluid, which may include the measured flow rate, fluid composition, density, pressure and temperature, until a difference between the generated values (e.g., a difference between a value generated in association with one iteration and a value generated in association with a subsequent iteration) is at or below a predetermined parameter or threshold (e.g., 1.0 cP or within 10% of the theoretical value) or until a predetermined number of iterations have taken place (e.g., ten iterations).

If the difference is at or below the predetermined parameter or threshold or if the predetermined number of iterations have taken place, the first and second valves 310 and 312 may actuate to an open position and the sample may flow through the second valve 312 in the direction generally represented by the arrows 340. Once the sample flows out of the second flowline section 306, the first and second valves 310 and 312 may actuate to the closed position and the above-described process may be repeated.

While in the above example the apparatus 300 is configured to generate a value representative of the viscosity of the sample, the example apparatus 300 may be used to generate a value representative of any other condition, property and/or characteristic of the sample such as, for example, density or fluid composition. In examples in which the example apparatus 300 is configured to generate a value representative of the fluid composition, the first and second fluid measurement units 314 and 316 (e.g., sensors 314 and 316) may be differently configured and/or employ different sensing principles to measure the fluid composition. However, in examples in which the example apparatus 300 is not configured to generate a value representative of the fluid composition, the example apparatus 300 may only be provided with one of the fluid measurements units 314 or 316.

Figure 4:
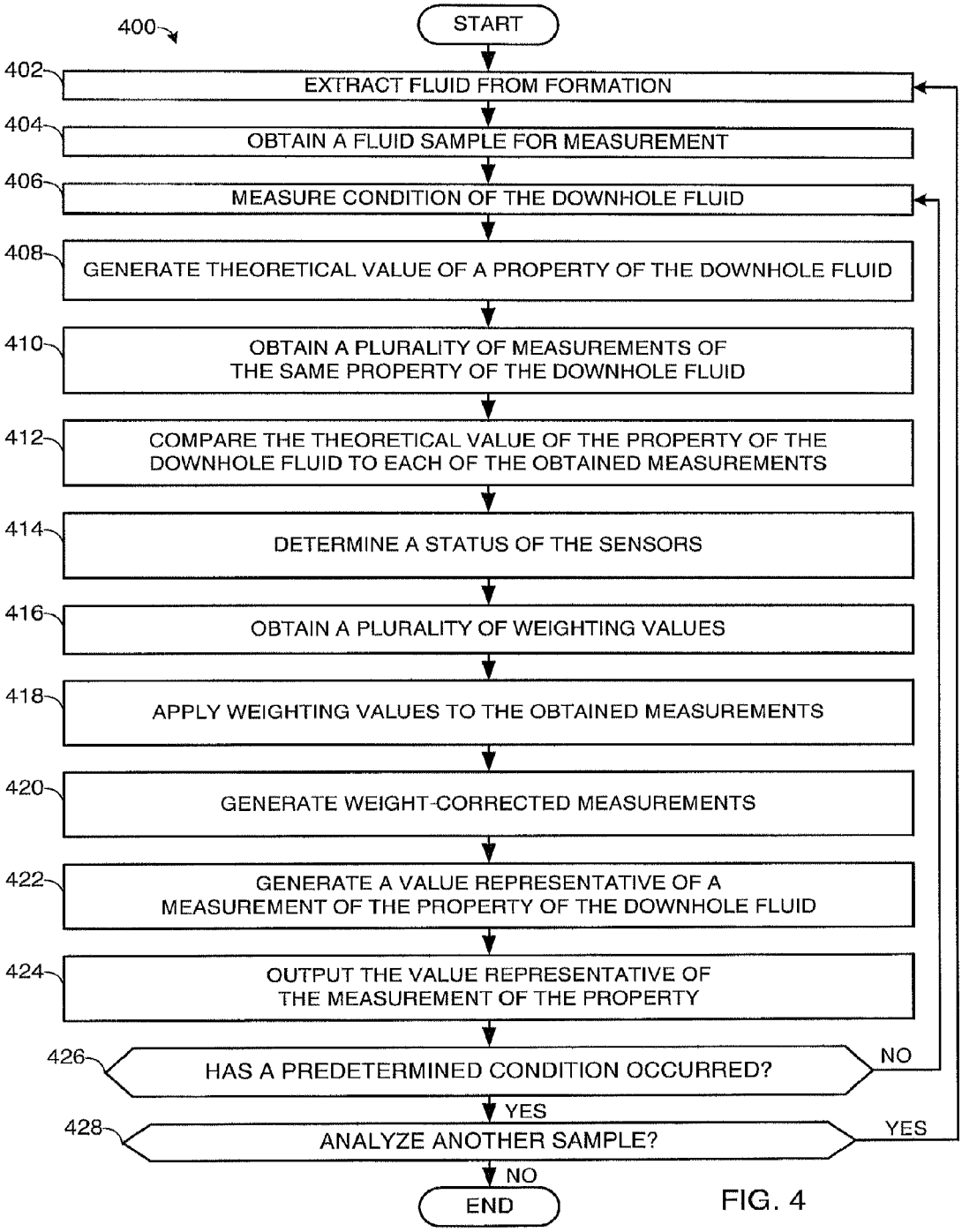
FIG. 4 is a flow diagram of an example method that may be used with the example apparatus described herein to generate a value representative of a measurement of a property of a downhole fluid.

FIG. 4 is a flowchart of an example method 400 that can be used in conjunction with the example apparatus described herein to draw and analyze formation fluid samples from a subterranean formation (e.g., the formation F of FIG. 1). The example method 400 of FIG. 4 may be used to implement the example formation tester 114 of FIG. 1, the formation sampling tool 200 of FIG. 2, and the example apparatus 300 of FIG. 3. The example method of FIG. 4 may be implemented using software and/or hardware. In some example implementations, the flowchart can be representative of example machine readable instructions, and the example method of the flowchart may be implemented entirely or in part by executing the machine readable instructions. Such machine readable instructions may be executed by the electronics and processing system 106 (FIG. 1) and/or the processing units 226 (FIG. 2) or 322 (FIG. 3). In particular, a processor or any other suitable device to execute machine readable instructions may retrieve such instructions from a memory device (e.g., a random access memory (RAM), a read only memory (ROM), etc.) and execute those instructions. In some example implementations, one or more of the operations depicted in the flowchart of FIG. 4 may be implemented manually. Although the example method is described with reference to the flowchart of FIG. 4, persons of ordinary skill in the art will readily appreciate that other methods to implement the example formation tester 114 of FIG. 1, the formation sampling tool 200 of FIG. 2, and the example apparatus 300 of FIG. 3 to analyze formation fluid samples may additionally or alternatively be used. For example, the order of execution of the blocks depicted in the flowchart of FIG. 4 may be changed and/or some of the blocks described may be rearranged, eliminated, or combined.

The example method 400 may be used to draw and analyze formation fluid using, for example, the formation sampling tool 200 of FIG. 2. Initially, the probe assembly 202 (FIG. 2) extracts (e.g., admits, draws, etc.) fluid from the formation F (block 402) and the valve 230 of FIG. 2 or the valves 310 and 312 of FIG. 3 actuate to an open position enabling a sample of the fluid to flow into the flowline 214 (FIG. 2) or the second flowline section 306 (FIG. 3). Once a predetermined amount of fluid has entered the flowline 214 (FIG. 2) or the second flowline section 306 (FIG. 3), the valve 230 (FIG. 2) or the valves 310 and 312 (FIG. 3) are actuated to the closed position to obtain a fluid sample for measurement (block 404). However, in other examples, in-line measurements may be obtained from the fluid. In such examples, the valve 230 (FIG. 2) or the valves 310 and 312 (FIG. 3) may not be actuated to the closed position or may be eliminated entirely. Generally, the examples described herein may be utilized in real-time fluid profiling and/or to determine fluid characteristics before sampling.

The fluid measurement units 210 (FIG. 2), 212 (FIG. 2), 314 (FIG. 3) and/or 316 (FIG. 3) and/or the sensors 216 (FIG. 2), the temperature sensor 318 (FIG. 3) and/or the pressure sensor 320 (FIG. 3) then measure a condition of the downhole fluid sample (block 406). In some examples, the condition of the downhole fluid sample may be, for example, a flowrate of the sample relative to the flowline 214 (FIG. 2) and/or the second flowline section 306 (FIG. 3), a fluid composition, a density, a fluid resistivity, a viscosity, salinity, a gas-oil ratio and/or any other fluid property or characteristic of the sample.

The measured values obtained using the fluid measurement units 210 (FIG. 2), 212 (FIG. 2), 314 (FIG. 3) and/or 316 (FIG. 3) and/or the sensors 216 (FIG. 2), the temperature sensor 318 (FIG. 3) and/or the pressure sensor 320 (FIG. 3) along with known properties of the drilling fluid are then utilized by the processing unit 226 (FIG. 2) and/or 322 (FIG. 3) to generate a theoretical value of a property (e.g., a theoretical viscosity value, a theoretical density value or theoretical fluid composition value) of the downhole fluid sample (block 408). Specifically, the processing unit 226 (FIG. 2) and/or 322 (FIG. 3) determines the theoretical value of the property of the downhole fluid sample based on a comparison of the measured conditions, characteristics and/or properties and known values (e.g., drilling fluid characteristics) with reference values stored in, for example, the reference database 228 (FIG. 2) and/or 324 (FIG. 3). As discussed above, the reference values may be reference values that were obtained from the subterranean formation being sampled or similar subterranean formations. Alternatively, the reference values may be generated from laboratory experiments under controlled conditions.

At least some of the sensors 216 (FIG. 2) and/or the sensors 332, 334 and 336 (FIG. 3), which may be differently configured and/or employ different sensing principles, then obtain a plurality of measurements of the same property of the downhole fluid sample (block 410). In some examples, the property may be the viscosity of the sample. However, in other examples, the property may be the density, the fluid composition or any other condition, property or characteristic of the sample. The processing unit 226 (FIG. 2) and/or 322 (FIG. 3) then compares the theoretical value of the property of the downhole fluid sample to each of the measurements obtained via the respective sensors 216 (FIG. 2), 332 (FIG. 3), 334 (FIG. 3) and/or 336 (FIG. 3) (block 412) to determine a status of each of the sensors 216 (FIG. 2), 332 (FIG. 3), 334 (FIG. 3) and/or 336 (FIG. 3) (block 414). In some example, the status of the respective sensors 216 (FIG. 2), 332 (FIG. 3), 334 (FIG. 3) and/or 336 (FIG. 3) may be properly functioning or improperly functioning, which may be based, at least in part, on an amount of deviation of the respective measurements from the theoretical value of the property.

The processing unit 226 (FIG. 2) and/or 322 (FIG. 3) then obtains a plurality of weighting values (block 416) that each correspond to one of the respective sensors 216 (FIG. 2), 332 (FIG. 3), 334 (FIG. 3) and/or 336 (FIG. 3). Specifically, obtaining the weighting values may include determining the weighting values based on the status of the respective sensor 216 (FIG. 2), 332 (FIG. 3), 334 (FIG. 3) and/or 336 (FIG. 3) and/or the condition of the downhole fluid as discussed above. For example, if the measurements obtained via each of the sensors 216 (FIG. 2), 332 (FIG. 3), 334 (FIG. 3) and/or 336 (FIG. 3) are substantially similar, the weighting values that correspond to each of the sensors 216 (FIG. 2), 332 (FIG. 3), 334 (FIG. 3) and/or 336 (FIG. 3), determined via the processing unit 226 (FIG. 2) and/or 322 (FIG. 3), may be substantially the same. However, if the measurements obtained via each of the sensors 216 (FIG. 2), 332 (FIG. 3), 334 (FIG. 3) and/or 336 (FIG. 3) are significantly different, weighting values that correspond to some of the of the sensors 216 (FIG. 2), 332 (FIG. 3), 334 (FIG. 3) and/or 336 (FIG. 3) may be relatively larger (e.g., closer to one), while weighting values that correspond to some of the other sensors 216 (FIG. 2), 332 (FIG. 3), 334 (FIG. 3) and/or 336 may be relatively smaller (e.g., closer to zero).

The processing unit 322 then applies the weighting values to the respective measurements (block 418) obtained via each of the corresponding sensors 216 (FIG. 2), 332 (FIG. 3), 334 (FIG. 3) and/or 336 (FIG. 3) to generate weight-corrected measurements (block 420) for each of the sensors 216 (FIG. 2), 332 (FIG. 3), 334 (FIG. 3) and/or 336 (FIG. 3). In some examples, applying the weighting values includes multiplying the corresponding weighting values and measurements.

Once the weight-corrected measurements are determined for each of the sensors 216 (FIG. 2), 332 (FIG. 3), 334 (FIG. 3) and/or 336 (FIG. 3), the processing unit 226 (FIG. 2) and/or 322 (FIG. 3) then generates (block 422) and outputs (block 424) a value representative of the measurement of the property of the sample based on the weight-corrected measurements. For example, generating a value representative of the measurement of the property of the sample may include averaging the weight-corrected measurements. Alternatively, generating a value representative of the measurement of the property may include summing the weight-corrected measurements to generate a weighted average value representative of the property. In some examples, outputting the value representative of the measurement of the property includes conveying the value to the reference database 228 (FIG. 2) and/or 324 (FIG. 3) for storage and/or conveying the value to a surface system (e.g., the electronics and processing system 106 FIG. 1)), via the tool bus 232 (FIG. 2), where it can be reviewed and/or interpreted via a user interface (not shown) of a workstation (not shown).

The processing unit 226 (FIG. 2) and/or 322 (FIG. 3) then determines if a predetermined condition has occurred (block 426). Specifically, the processing unit 226 (FIG. 2) and/or 322 (FIG. 3) determines if a difference between the generated values (e.g., a difference between a value generated in association with one iteration and a value generated in association with a subsequent iteration) is at or below a predetermined parameter or threshold (e.g., 1.0 cP or within 10% of the theoretical value) or until a predetermined number of iterations have taken place (e.g., ten iterations). If the processing unit 226 (FIG. 2) and/or 322 (FIG. 3) determines that the predetermined condition has occurred, the processing unit 226 (FIG. 2) and/or 322 (FIG. 3) then determines whether it should analyze another formation fluid sample (block 428). For example, if the formation sampling tool 200 (FIG. 2) has drawn another formation fluid sample and the processing unit 226 (FIG. 2) and/or 322 (FIG. 3) has not received an instruction or command to stop analyzing fluid, the processing unit 226 (FIG. 2) and/or 322 (FIG. 3) may determine that it should analyze another fluid sample (block 428). Otherwise, the example process 400 of FIG. 4 is ended.

Figure 5:
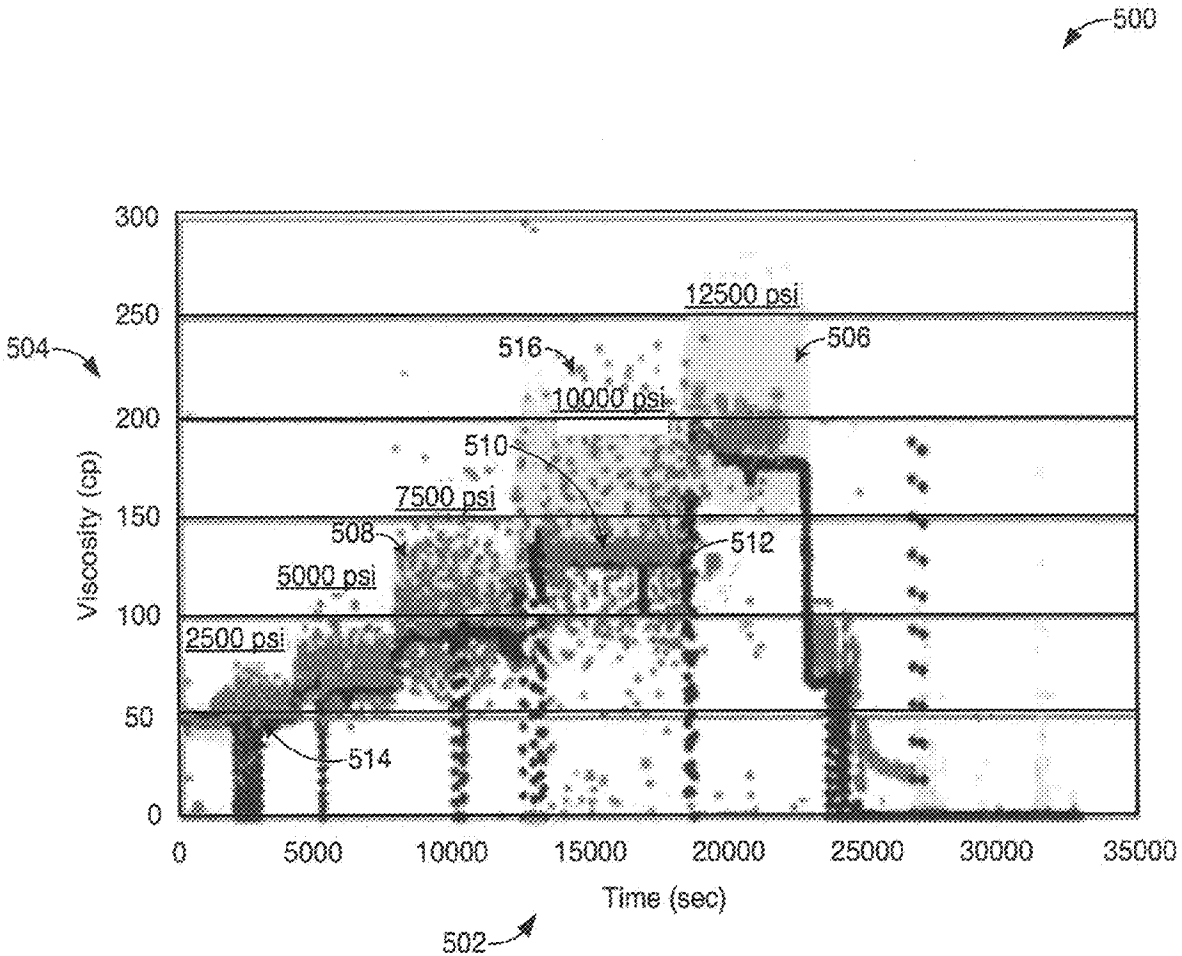
FIG. 5 depicts results obtained using the methods and apparatus described herein.

FIG. 5 depicts a graph 500 of measurements obtained using the examples described herein of a downhole fluid having a relatively high viscosity. An x-axis 502 represents time (sec) and a y-axis 504 represents viscosity (cP). The measurements were obtained using a paddle type sensor (e.g., a DV-rod sensor), a vibrating wire sensor operating in a time domain configuration, a vibrating wire sensor operating in a frequency domain configuration and a laboratory viscosity sensor, which is inoperable under downhole conditions and may be considered as providing theoretical viscosity values of the downhole fluid.

Some of the measurements obtained via the paddle sensor are generally represented by arrow 506, some of the measurements obtained via the vibrating wire sensor operating in a time domain configuration are generally represented by arrow 508, some of the measurements obtained via the vibrating wire sensor operating in a frequency domain configuration are generally represented by arrow 510 and some of the measurements obtained via the laboratory viscosity sensor are generally represented by arrow 512. As shown in the graph 500, when the viscosity of the downhole fluid is approximately 50 cP, all of the measurements obtained via the different sensors are approximately the same, which is generally represented by arrow 514. Thus, the measurements obtained via each of the sensors may be weighted substantially equally and/or taken into consideration when generating a value representative of the viscosity of the downhole fluid. However, as the viscosity of the downhole fluid increases, the measurements obtained via the paddle sensor and the vibrating wire senor operating in a time domain configuration deviate from the theoretical viscosity (e.g., partially due to an amount of noise associated with these sensors), which is generally represented by arrow 516, because, as discussed above, both of these of sensors have a limited maximum measurable viscosity. As a result, as the viscosity of the downhole fluid increases, the measurements obtained via the paddle sensor and the vibrating wire senor operating in a time domain configuration are given little, if any, weight and/or not taken into consideration by the processing unit 226 (FIG. 2) and/or 322 (FIG. 3) when generating a value representative of the viscosity of the downhole fluid. In contrast, the measurements obtained via the vibrating wire sensor operating in a frequency domain configuration are given a relatively large amount of weight by the processing unit 226 (FIG. 2) and/or 322 (FIG. 3) when generating a value representative of the viscosity of the downhole fluid, because, as discussed above, this type of sensor can accurately measure samples having a relatively high viscosity.

Figure 6:
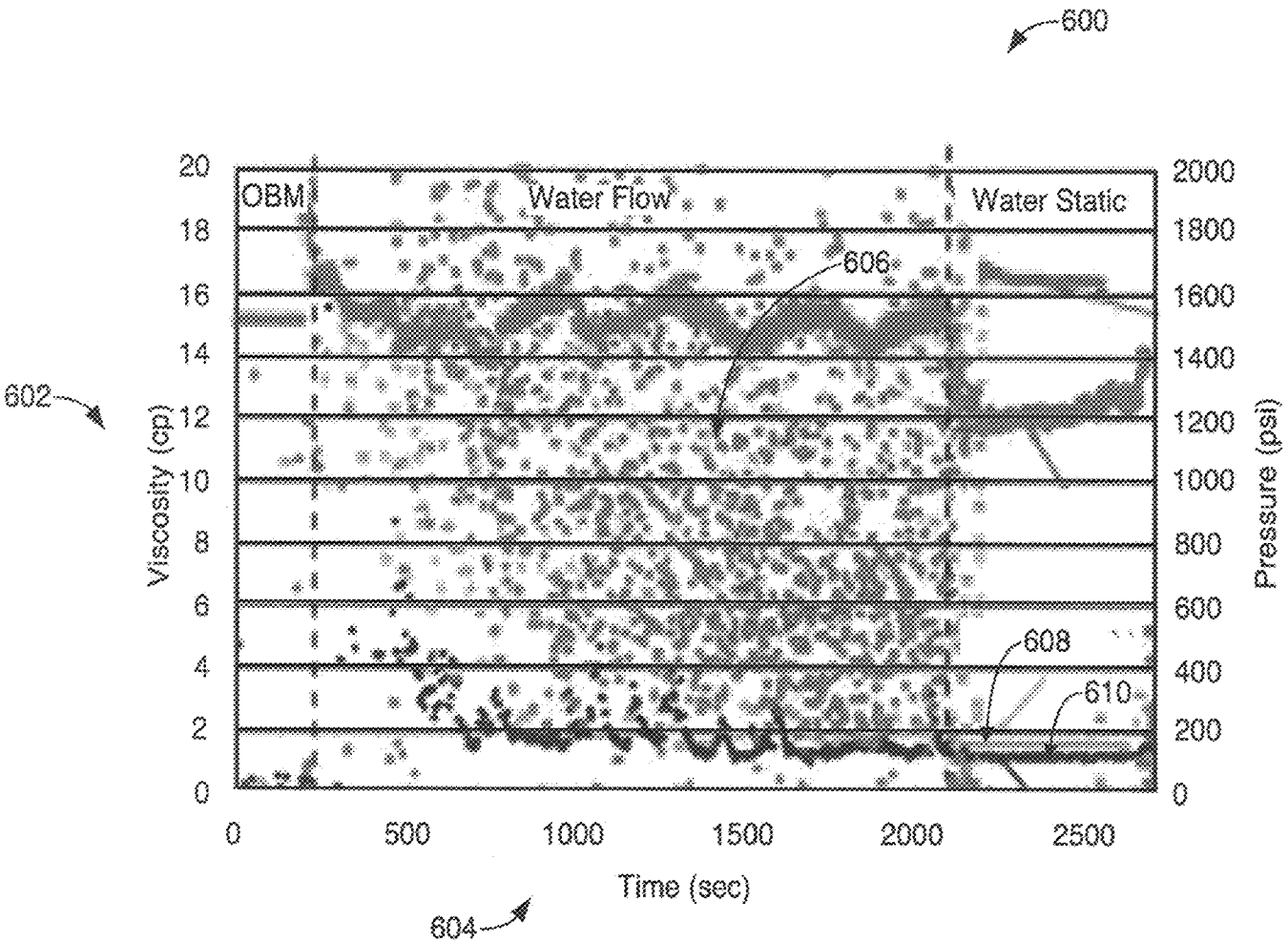
FIG. 6 depicts results obtained using the methods and apparatus described herein.

FIG. 6 depicts a graph 600 of measurements obtained using the examples described herein as the fluid sample changes from an oil-based mud to water. An x-axis 602 represents time (sec) and a y-axis 604 represents viscosity (cP). The measurements were obtained using a paddle type sensor (e.g., a DV-rod sensor), a vibrating wire sensor operating in a time domain configuration and a vibrating wire sensor operating in a frequency domain configuration.

Some of the measurements obtained via the paddle sensor are generally represented by arrow 606, some of the measurements obtained via the vibrating wire sensor operating in a time domain configuration are generally represented by arrow 608 and some of the measurements obtained via the vibrating wire sensor operating in a frequency domain configuration are generally represented by arrow 610. As shown in the graph 600, measurements obtained via the paddle sensor, which are generally represented by the arrow 606, are unstable and deviate significantly from the measurements obtained via the other two sensors. As a result, the measurements obtained via the paddle sensor are given little, if any, weight and/or not taken into consideration by the processing unit 226 (FIG. 2) and/or 322 (FIG. 3) when generating a value representative of the viscosity of the downhole fluid. In contrast, the measurements obtained via the vibrating wire sensor operating in a time domain configuration and the vibrating wire sensor operating in a frequency domain configuration, which are generally represented by the arrows 608 and 610, respectively, are substantially stable and, thus, are given a relatively large amount of weight by the processing unit 226 (FIG. 2) and/or 322 (FIG. 3) when generating a value representative of the viscosity of the downhole fluid.

FIG. 7 is a schematic diagram of an example processor platform P100 that may be used and/or programmed to implement to implement the electronics and processing system 106, the processing units 226 and 322, the fluid measurement units 210, 212, 314 and 316 and the sensors 216, 332, 334 and 336, For example, the processor platform P100 can be implemented by one or more general purpose processors, processor cores, microcontrollers, etc.

The processor platform P100 of the example of FIG. 7 includes at least one general purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example methods and apparatus described herein.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown).

The processor platform P100 also includes an interface circuit P130. The interface circuit P130 may be implemented by any type of interface standard, such as an external memory interface, serial port, general purpose input/output, etc. One or more input devices P135 and one or more output devices P140 are connected to the interface circuit P130.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method of measuring a property of a downhole fluid, comprising:

generating a theoretical value of a property of the downhole fluid based on a condition of the downhole fluid;

obtaining a plurality of measurements for each of a plurality of sensors, wherein each of the measurements corresponds to a same property of the downhole fluid, and wherein each of the sensors is differently configured to measure the property;

obtaining a plurality of weighting values, each of which corresponds to one of the sensors, wherein obtaining the plurality of weighting values comprises determining the weighting values based on at least a status of each sensor or the condition of the downhole fluid;

applying the weighting values to the measurements obtained by each of the corresponding sensors to generate a weight-corrected measurement for each of the sensors;

generating a value representative of a measurement of the property of the downhole fluid based on the weight-corrected measurements; and outputting the value representative of the measurement of the property.

2. The method as defined in claim 1, wherein at least two of the sensors employ different sensing principles.

3. The method as defined in claim 1, wherein the property is viscosity.

4. The method as defined in claim 1, wherein the property is density.

5. The method as defined in claim 1, wherein the property is fluid composition.

6. The method as defined in claim 1, wherein the condition of the downhole fluid is a flowrate of the downhole fluid.

7. The method as defined in claim 1, wherein the condition of the downhole fluid is at least one of a temperature, a pressure, a density, a viscosity, or a fluid composition of the downhole fluid.

8. The method as defined in claim 1, wherein applying the weighting values comprises multiplying corresponding weighting values and measurements.

9. The method as defined in claim 1, wherein generating the value representative of the measurement of the property of the downhole fluid based on the weight-corrected measurements comprises summing the weight-corrected measurements to generate a weighted average value representative of the property.

10. The method as defined in claim 1, further comprising eliminating a measurement associated with a failed sensor.

11. The method as defined in claim 1, further comprising comparing the theoretical value of the property of the downhole fluid to the measurements obtained via each of the plurality of sensors.

12. The method as defined in claim 11, wherein the status of the respective sensor is based, at least in part, on the comparison.

* * * * *